US006033250A

United States Patent [19]

Pauza

[11] Patent Number: 6,033,250

[45] Date of Patent: Mar. 7, 2000

[54] LATCHING CONNECTOR

[75] Inventor: William Vito Pauza, Palmyra, Pa.

[73] Assignee: The Whitaker Corporation, Wilmington, Del.

[21] Appl. No.: 09/008,638

[22] Filed: Jan. 16, 1998

Related U.S. Application Data

[60] Provisional application No. 60/042,156, Mar. 31, 1997.

[51] Int. Cl.[7] ..... H01R 13/627

[52] U.S. Cl. ..... 439/357; 439/953

[58] Field of Search ..... 439/352, 253, 439/258, 357, 953, 358, 353, 350, 282

[56] References Cited

U.S. PATENT DOCUMENTS

| | | | |
|---|---|---|---|
| 4,880,393 | 11/1989 | Moji | 439/352 |
| 4,915,650 | 4/1990 | Daly et al. | 439/498 |
| 4,993,967 | 2/1991 | Matsumato | 439/489 |
| 5,041,017 | 8/1991 | Nakazato et al. | 439/509 |
| 5,183,430 | 2/1993 | Swann | 446/104 |
| 5,254,013 | 10/1993 | Tanaka | 439/352 |
| 5,580,268 | 12/1996 | Miyazawa | 439/352 |
| 5,702,266 | 12/1997 | Jones | 439/357 |
| 5,749,745 | 5/1998 | Flother et al. | 439/349 |
| 5,839,968 | 11/1998 | Latella | 473/219 |
| 5,876,230 | 3/1999 | Nishide | 439/352 |
| 5,971,790 | 10/1999 | Rohde | 439/357 |

*Primary Examiner*—Neil Abrams
*Assistant Examiner*—Chandrika Prasad

[57] ABSTRACT

This invention is related to a latchable connector (10) having a plug (12) and a header (14). The header consists of a plug-receiving section (26) along with a pair of posts (16) which are mechanically connected to a printed circuit board. The posts (16) serve to secure the header (14) to a plug through a plurality of latches (30) mounted in the plug housing (11). Locking projections (58) of the latch (30) engage annular grooves (18) of the posts (16) in order to secure the plug (12) to the header (14). A force applied to the latches (30) to urge them towards each other will serve to release the plug (12) from the header (14).

9 Claims, 4 Drawing Sheets

LATCHING CONNECTOR

This application claims the benefit of U.S. Provisional Application Ser. No. 60/042,156, Filed Mar. 31, 1997.

FIELD OF THE INVENTION

This invention is related to electrical connectors and more particularly a latching mechanism for such connectors.

BACKGROUND OF THE INVENTION

Electrical connections to printed circuit boards are accomplished in several ways. Connections are made through soldering components directly to pads or traces on the printed circuit board, through card edge connections to an electrical connector which is integral to another device or circuit board, and also between a header mounted on the printed circuit board and an electrical connector such as a plug at the end of a wire harness.

A problem arises when using a header connection in that the header must be mechanically mounted to the printed circuit board so as to resist breaking caused by a pulling force on the wire harness. Currently, this problem is addressed by mechanically securing the harness plug connector directly to the printed circuit board through fasteners such as bolts or screws. This type of arrangement is not easily disconnectable and also requires additional board real estate for the fasteners. It is therefore desirable to secure the header connector to the printed circuit board and establish electrical connection to the harness plug connector with sufficient mechanical retention to prevent separation or breaking of either the header connector or the harness plug connector.

SUMMARY OF THE INVENTION

It is an object of this invention to provide an electrical connector which is capable of establishing both electrical and mechanical connection between a wiring harness and a printed circuit board.

This object has been achieved by providing an electrical connector having a header being mechanically secured to the printed circuit and a plug connected at the end of a wiring harness. A latch is disposed along an edge of the plug and has a main body from which a latch arm is bent at a right angle and extends along a central axis from the body to a free end. The free end is defined by a securing portion being slightly larger than the remainder of the latch arm. The securing portion has a locking projection extending therefrom at the free end. A spring arm also extends at an acute angle from the body angle and towards the latch arm. The free end of the spring arm is profiled to engage an outer surface of the plug housing so that when a force is applied to the body it will cause deflection of the spring arm to effect a motion of the latch arm along the central axis.

BRIEF DESCRIPTION OF THE DRAWINGS

The invention will now be described by way of example with reference to the accompanying drawings of which.

DETAILED DESCRIPTION OF SEVERAL EMBODIMENTS

Figure 1:
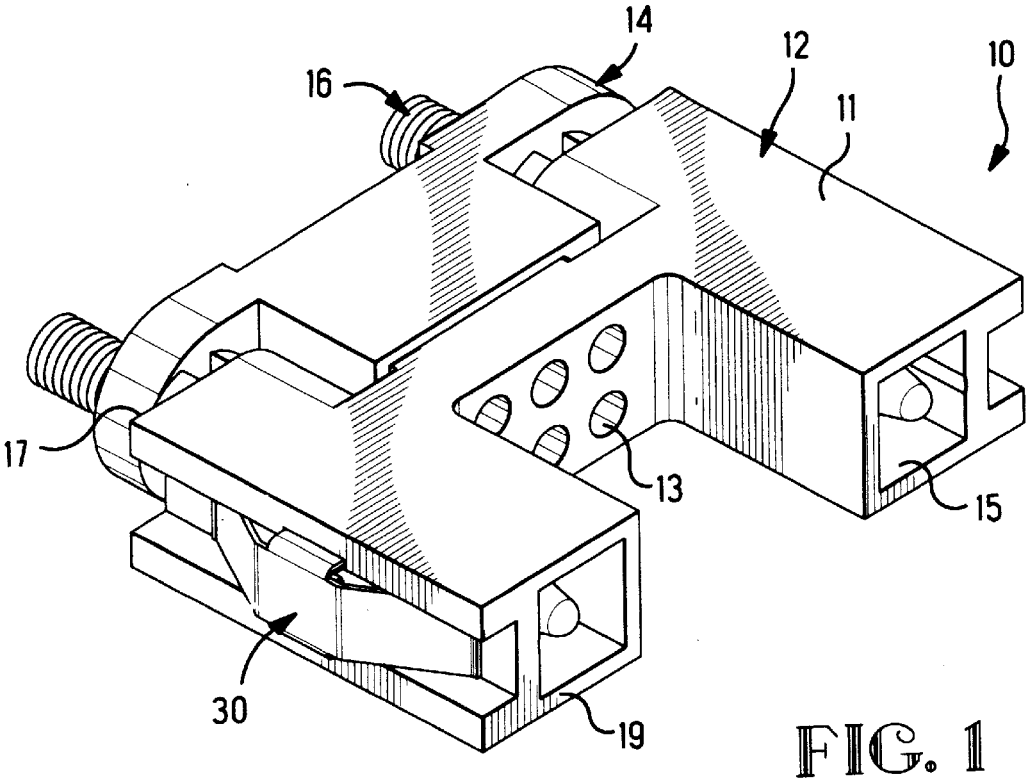
FIG. 1 shows a three-dimensional view of the electrical connector according to the present invention.

Referring first to FIG. 1, the electrical connector 10 having the latch 30 will be generally described. This electrical connector 10 consists two mating halves 12,14. The plug 12 features a plurality of contact-receiving openings 13 and a pair of post-receiving openings 15 which extend from the mating end 17 to the cable end 19. Latches 30 are disposed along the sides of the plug 12. The header 14 has a pair of post-receiving openings 24 (FIG. 2) disposed on opposite ends and a plug-receiving area 26 between the two post-receiving openings 24. A pair of posts 16 are disposed inside each post-receiving opening 24.

Figure 2:
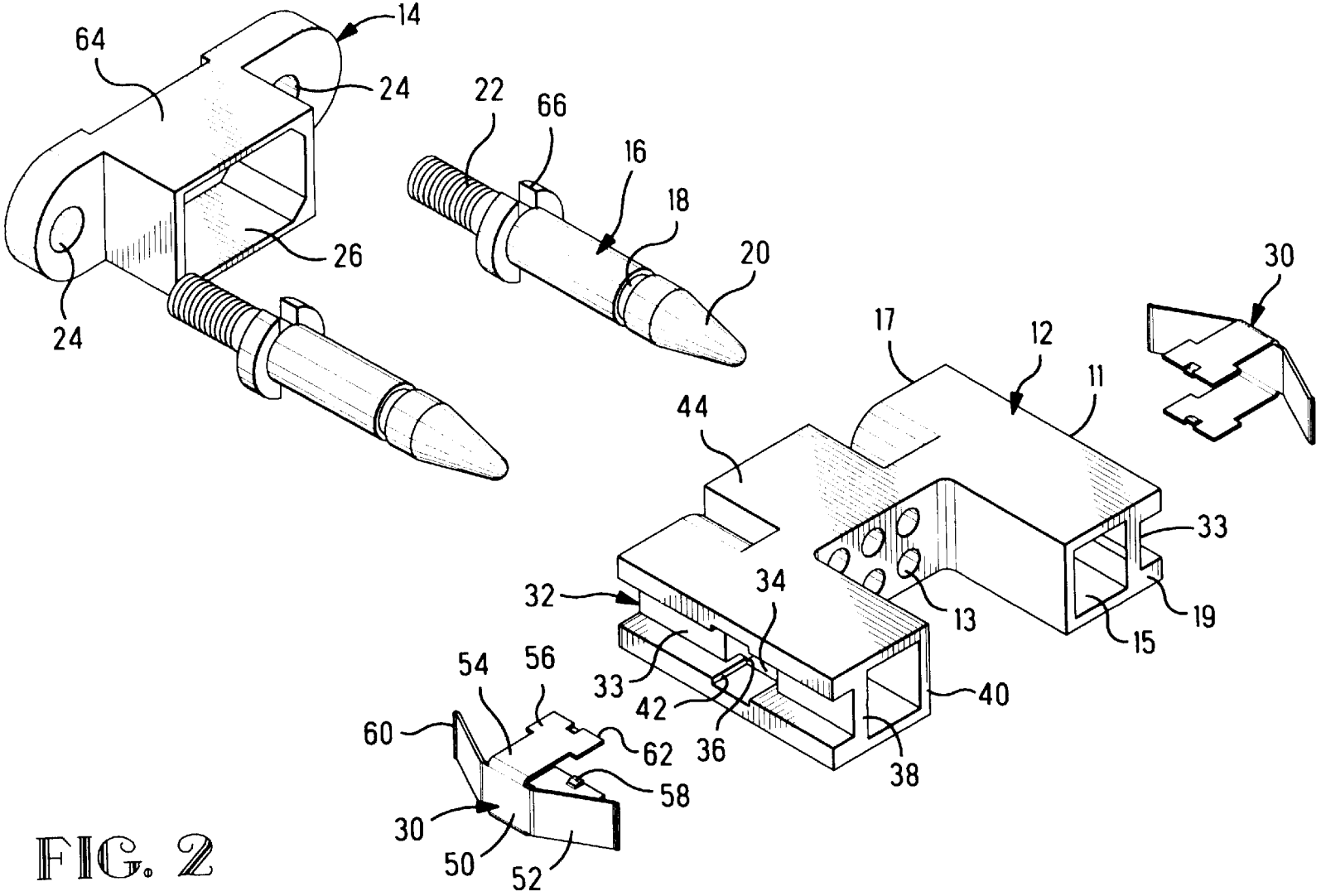
FIG. 2 shows an exploded three-dimensional view of the electrical connector of FIG. 1.

Each of the major components will now be described in greater detail with reference to FIG. 2. First the plug 12 consists a housing 11 having a plurality of contact-receiving openings 13 extending from the mating end 17 toward the cable end 19. A pair of post-receiving openings 15 also extend from the mating end 17 to the cable end 19. These post-receiving openings 15 are defined by a pair of sidewalls 38,40. A plug section 44 is disposed around the plurality of contact-receiving openings 13. A pair of latch-receiving sections 32 are disposed along sides of the housing 11 and consists of a spring channel 33 and a latch opening 34 which extends from the spring channel 33 to the side wall 40. The latch opening 34 is profiled to have a shoulder 42 extending from the spring channel 33 partially into the latch opening 34. Stop surface 36 is defined by the end of the shoulder 42 which is inside the latch-receiving opening 34.

A pair of latches 30 are provided along the sides of the housing 11 and are received into the latch-receiving sections 32. Each latch 30 consists of a main body 50 from which a pair of spring arms 52 and a pair of latch arms 54 extend. The latch arms 54 extend at substantially a right angle from the main body 50. Near each of the free ends 62 of the latch arms 54, a securing tab 56 is provided. Locking projections 58 extend from the securing tabs 56 towards each other. A pair of spring arms 52 extend from the main body 50 at an acute angle toward the latch arms 54. Free ends 60 of the spring arms 52 are flared and profiled to slidingly engage the spring channels 33.

Referring once again to FIG. 2, the header 14 is shown consisting of a housing 64 having a pair of post-receiving openings 24 and a plug-receiving opening 26 disposed between the post-receiving openings 24. A pair of posts 16 are generally cylindrical and profiled to have a threaded section 22, an annular flange 66, an annular groove 18, and a tapered section 20. The threaded sections 22 are received in the post-receiving openings 24.

Assembly and mating of the electrical connector 10 will now be described in greater detail again with reference to FIG. 2. The latches 30 are first assembled into the housing 11 by urging the spring arms 54 toward each other such that they clear the shoulders 42. The latch is then urged into the latch-receiving opening 34 until the tab 56 passes and engages the stop surface 36 causing the latch arms 54 to return to their relaxed position and lock behind the shoulder 42. It should be understood that when in the locked position, the free ends 60 of the spring arms 52 will be in engagement with the spring channel 33 in order to urge the tab 56 toward the stop surface 36.

Posts 16 are assembled to the header 14 through post-receiving openings 24. The threaded sections 22 pass through the openings 24 and are secured to a printed circuit board using nuts (not shown). This provides mechanical connection to the printed circuit board.

Figure 3:
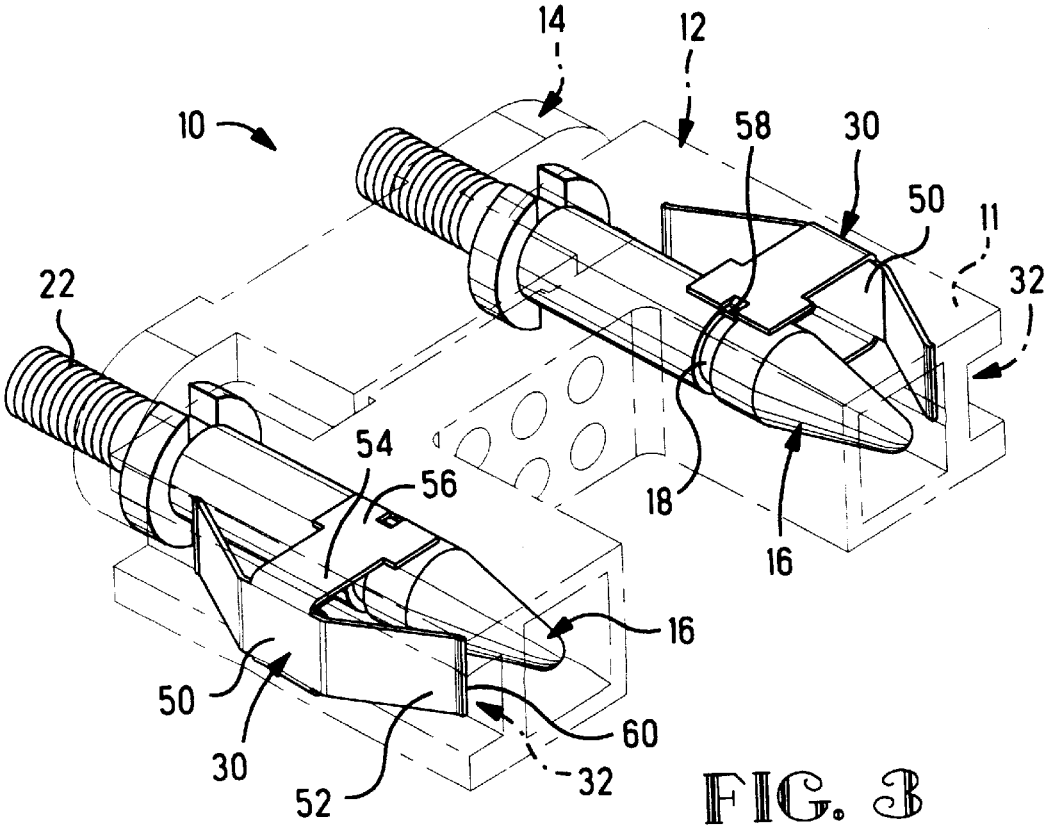
FIG. 3 shows a three-dimensional view of the electrical connector of FIG. 1 wherein the housings are displayed in phantom.
Figure 4:
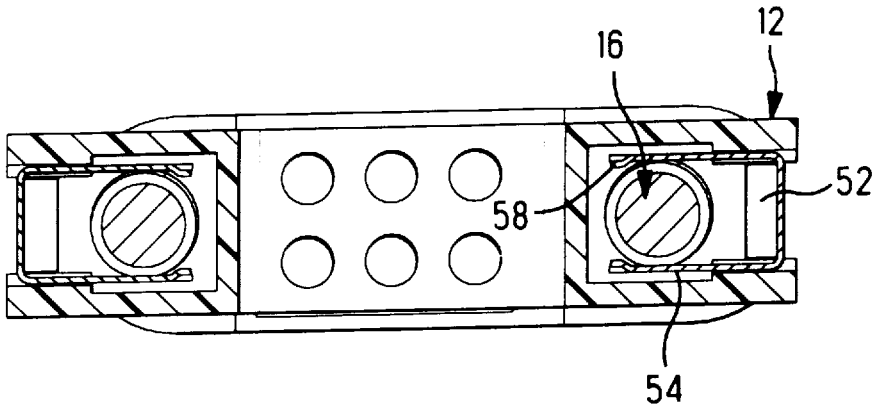
FIG. 4 shows a cross-sectional view of the connector of FIG. 1 having the latches depressed in a release position.

A mating cycle will now be described with reference to FIGS. 3–5. Beginning with FIG. 3, the connector 10 is shown in the mated condition with the connector housings 11,14 shown in phantom. It should be noted that contacts have been removed in order to more clearly show the latching mechanism. The latches 30 are disposed such that the tabs 56 are in engagement with the stop surfaces 36. The free ends 60 are in engagement with the spring channel 33. Locking projections 58 are positioned inside annular grooves 18 of the posts 16. When the posts 16 are secured to a printed circuit board, the plug 12 will be prevented from separation due to the engagement of the locking projections 58 with the annular grooves 18. In order to remove the plug 12, the latches 30 may be depressed in the area of the main body 50 toward each other. This will cause the spring arms 52 to deflect such that the free ends slide along the spring channel 33. This causes the latch arms 54 to move inward towards each other to resulting in a misalignment between the locking projections 58 and the annular grooves 18 as best shown in FIG. 4. Here it can be seen that the locking projections 58 are urged towards each other such that they are removed from the annular grooves 18 causing the plug 12 to be releaseable from the posts 16 of the header 14.

Figure 5:
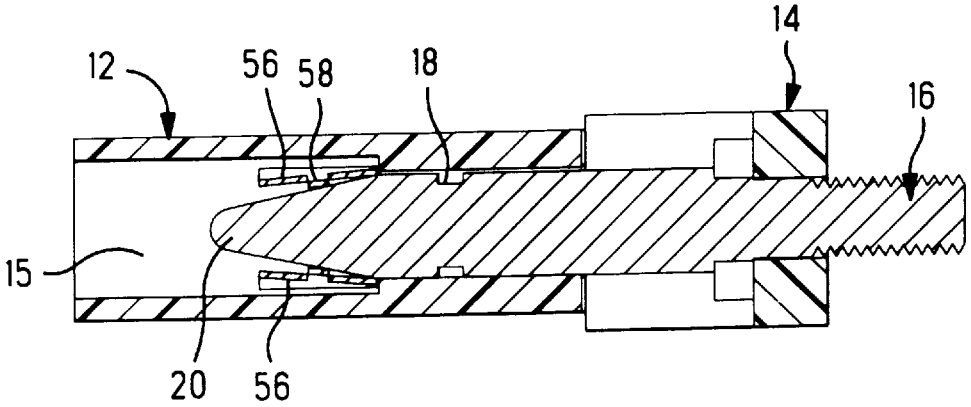
FIG. 5 shows a cross-sectional view of the connector of FIG. 1 having the latch in a prelatch position.

FIG. 5 shows a cross sectional view of the plug 12 and header 14 taken along one side. Here it can be seen that the plug 12 and header 14 are mated by simply inserting the posts 16 into the post-receiving openings 15 of the plug 12. The tabs 56 and locking projections 58 ride up the tapered surface 20 of the post 16 as the plug 12 is mated to the header 14. The plug 12 is further urged towards the header 14 until the locking projections 58 are aligned with and snapped into the annular groove 18 as shown in FIG. 3.

Figure 6:
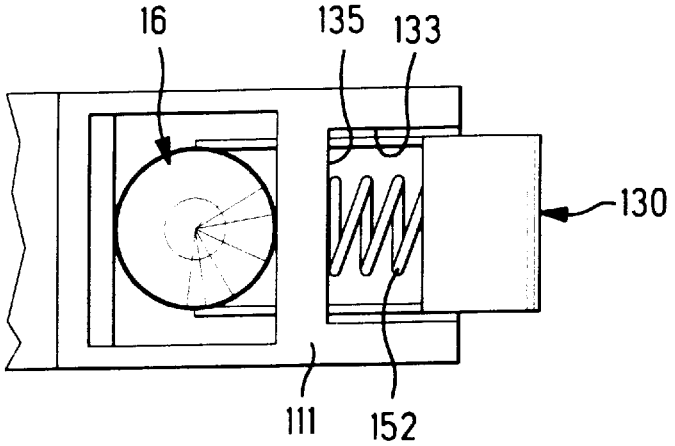
FIG. 6 shows a partial end view of an alternate embodiment having a coil spring in place of the spring arms.
Figure 7:
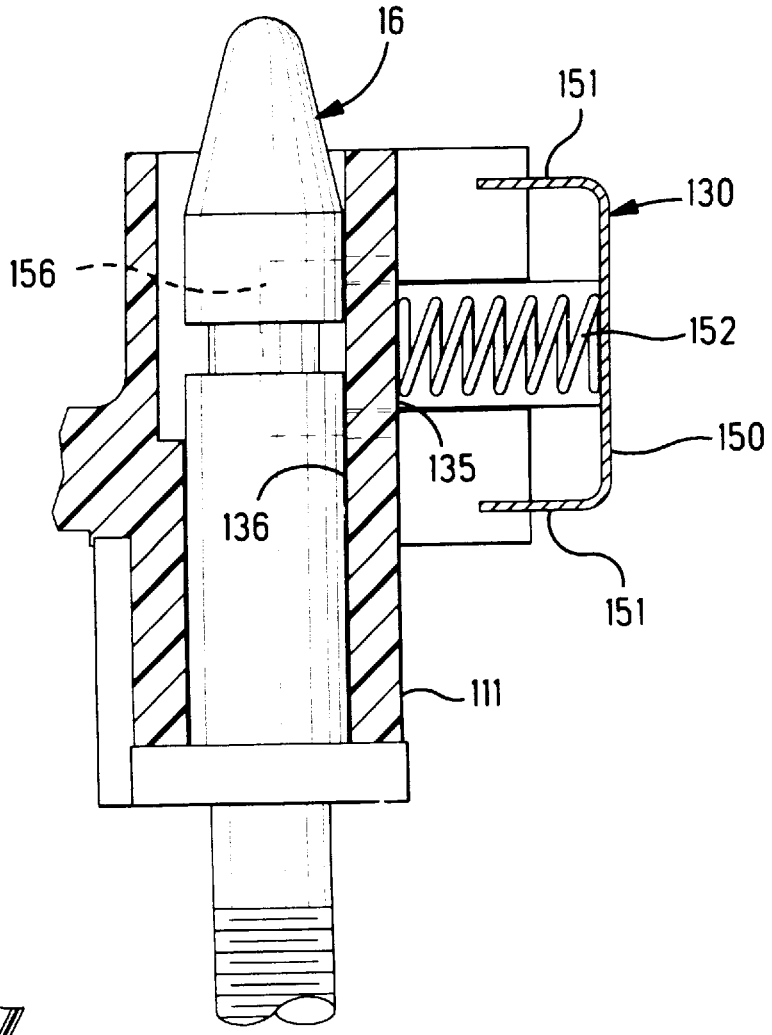
FIG. 7 shows a cross sectional view similar to that of FIG. 5 for the alternate embodiment of FIG. 6.

FIGS. 6 and 7 show a first alternate embodiment of the present invention. FIG. 6 represents a partial sectional view similar to that of FIG. 4 in which the spring arms 52 of the previous embodiment are replaced with a coil spring 152. The coil spring 152 is disposed between the main body 150 and the spring channel 133. The main body 150 has two overstress extensions 151 (FIG. 7) extending therefrom to prevent the latch 130 from traveling beyond the release position as shown for example in FIG. 4. In this embodiment, the spring channel 133 is profiled to have a spring receiving area 135 in the vicinity of the latch opening 34. The coil spring 152 serves to urge the latch 130 outward such that the tab 156 is biased against the stop surface 136 of the housing 111. The latch arms 54 are structurally the same as those of the previous embodiment.

Figure 8:
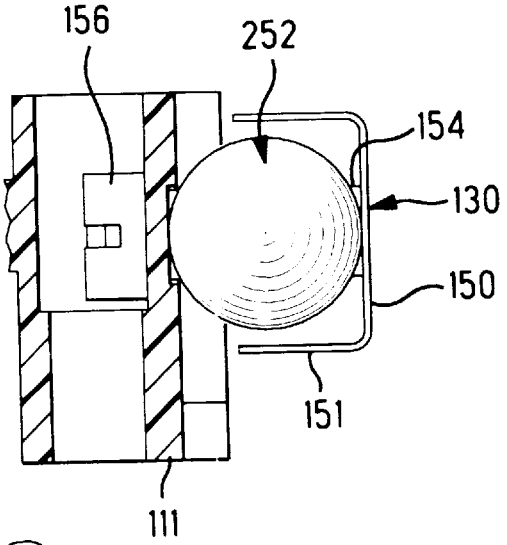
FIG. 8 shows a partial cross sectional view similar to that of FIG. 7 for a second alternate embodiment wherein the coil spring is replaced by a pliable ball.

FIG. 8 shows yet another embodiment of the present invention in which the coil spring 152 of FIG. 7 is replaced by a pliable ball 252. The latch 150 is structurally the same as the latch 150 of the previous embodiment. The pliable ball 252 may be formed of a rubber of other suitable pliable material which has the ability to exert a sufficient force on the main body 150 to bias the tab 156 against the stop surface 136. The pliable ball must be appropriately sized to allow sufficient travel of the latch arms 154 between the latching position (FIG. 3) and the release position (FIG. 4.).

An advantage of this invention is that it provides a reliable mechanical and electrical connection between a plug 12 and a header 14 mounted to a printed circuit board. The latch 30 is housed almost completely inside the plug in order to minimize the board real estate necessary for mechanical connection.

Changes in construction will occur to those skilled in the art and various apparently different modifications and embodiments may be made without departing from the scope of the invention. The matter set forth in this description and accompanying drawings is offered by way of illustration only. It is therefore intended that the foregoing description be regarded as illustrative rather than limiting.

I claim:

1. A latch for use in an electrical connector having a housing comprising:

a main body, a latch arm bent at a right angle to said main body and extending along a central axis from said main body to a free end having a locking projection, the free end being profiled to have a tab which is engageable with a stop surface of the housing when in a locking position, and a plurality of spring arms extending from said main body at an acute angle toward said latch arm, said plurality of spring arms each having a free end to engage a portion of the housing for spring biasing said latch arm against the stop surface, whereby a force applied to said main body causes the deflection of said spring arms and a motion of said latch arm along this central axis.

2. An electrical connector being matable with a complementary connector and securable thereto by a latching mechanism comprising:

a latch disposed in a latch receiving recess of a first housing, the latch having a pair of opposing latch arms extending from a main body of said latch at approximately a right angle, a spring being in cooperation with the latch main body to urge the latch toward a latching position, and a post secured to a second housing and extending therefrom toward the first housing, said post being receivable and securable between the opposing latch arms when the latch is in a latching position.

3. The latching arrangement of claim 2 wherein the spring comprises a pair of spring arms each extending in opposite directions from the main body and at an acute angle toward the latch arm, each of the spring arms having a free end in engagement with a side of the first housing.

4. The latching arrangement of claim 2 wherein the spring comprises a helical spring disposed between the main body and a side of the first housing.

5. The latching arrangement of claim 2 wherein the spring comprises a pliable ball disposed between the main body and a side of the first housing.

6. A latching arrangement for an electrical connector comprising:

latch disposed in a first connector housing, said latch having a main body, a latch arm extending from the main body in a direction which is traverse to a mating direction, the latch arm having a securing tab and a latching projection at a free end, and a spring member cooperating with the main body to urge the latch arm to a latching position, and, a post disposed in a second connector housing, said post being receivable by said latch in a mating direction and having a groove which is engageable with the latching projection of the latch.

7. The latching arrangement of claim 6 wherein the spring member comprises a pair of spring arms each extending in opposite directions from the main body and at an acute angle toward the latch arm, each of the spring arms having a free end in engagement with a side of the first housing.

8. The latching arrangement of claim 6 wherein the spring member comprises a helical spring disposed between the main body and a side of the first housing.

9. The latching arrangement of claim 6 wherein the spring member comprises a pliable ball disposed between the main body and a side of the first housing.

* * * * *